United States Patent [19]

Ikematsu et al.

[11] Patent Number: 4,502,950

[45] Date of Patent: Mar. 5, 1985

[54] PROCESS FOR THE SOLVENT DEASPHALTING OF ASPHALTENE-CONTAINING HYDROCARBONS

[75] Inventors: Masaki Ikematsu; Isao Honzyo; Kazuo Sakai, all of Yokohama, Japan

[73] Assignee: Nippon Oil Co., Ltd., Tokyo, Japan

[21] Appl. No.: 575,717

[22] Filed: Jan. 31, 1984

Related U.S. Application Data

[63] Continuation-in-part of Ser. No. 460,446, Jan. 24, 1983, abandoned.

[30] Foreign Application Priority Data

Jan. 15, 1982 [JP] Japan ..... 57-8774
Feb. 15, 1982 [JP] Japan ..... 57-21206

[51] Int. Cl.[3] ..... C10G 21/40
[52] U.S. Cl. ..... 208/309
[58] Field of Search ..... 208/309

[56] References Cited

U.S. PATENT DOCUMENTS

| | | | |
|---|---|---|---|
| 2,367,385 | 1/1945 | Weeks et al. | 208/309 |
| 2,521,357 | 9/1950 | Furnoy et al. | 208/309 |
| 3,530,006 | 9/1970 | Kuwata | 208/309 |
| 3,798,157 | 3/1974 | Manzanilla et al. | 208/309 |
| 4,054,512 | 10/1977 | Dugan et al. | 208/309 |
| 4,191,639 | 3/1980 | Audeh et al. | 208/309 |

*Primary Examiner*—Delbert E. Gantz
*Assistant Examiner*—Helane Myers
*Attorney, Agent, or Firm*—Bucknam and Archer

[57] ABSTRACT

A continuous process for solvent deasphalting asphaltene-containing hydrocarbons which comprises mixing (A) 100 parts by weight of asphaltene-containing hydrocarbons with (B) 0.005–0.5 parts by weight of an amorphous silicon dioxide and/or a silicate compound and also with (C) 5–2000 parts by weight of a solvent such as n-heptane, n-hexane, n-heptane or a mixed n-pentane.n-butanol solvent, to form a mixture which is then allowed to stand still to precipitate and separate the asphaltene therefrom thereby obtaining a deasphalted oil.

8 Claims, 3 Drawing Figures

PROCESS FOR THE SOLVENT DEASPHALTING OF ASPHALTENE-CONTAINING HYDROCARBONS

Figure 1:
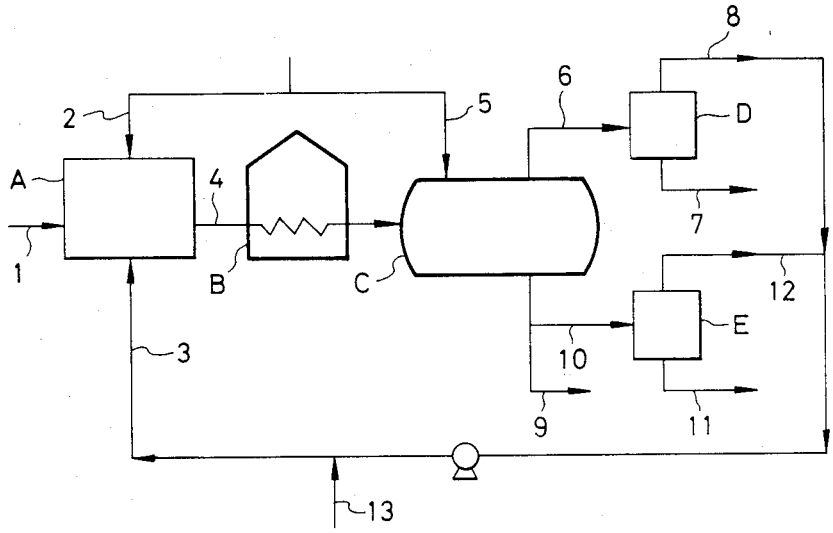

This application is a continuation-in-part of U.S. Ser. No. 460,446 filed Jan. 24, 1983 now abandoned.

This invention relates to a continuous process for the solvent deasphalting of asphaltene-containing hydrocarbons and more particularly it relates to an improved continuous process for the solvent deasphalting of asphaltene-containing hydrocarbons which comprises adding a specific compound and a specific solvent to asphaltene-containing hydrocarbons to separate the asphaltene from said asphaltene-containing hydrocarbons.

Naturally occurring hydrocarbons generally contain a large proportion of aromatic ingredients and also contain a large amount of comparatively high molecular weight asphaltene containing compounds, in concentrated form, including various metal ingredients, sulphur, nitrogen and the like other than carbon and nitrogen. Such asphaltene as contained in the hydrocarbons is harmful in remarkably decreasing the catalytic activity due to the metal ingredients included in the asphaltene in the step of catalytic hydrogenation or catalytic cracking of heavy fraction oils for example. For this reason, when asphaltene-containing hydrocarbons are treated for their effective use, it is often necessitated to remove therefrom the asphaltene which is a harmful ingredient.

A conventional method for the removal of the asphaltene from asphaltene-containing hydrocarbons is generally illustrated by a solvent deasphalting method comprising using low boiling paraffinic hydrocarbons including propane and butane to light naphtha in separating and removing the asphaltene from asphaltene-containing hydrocarbons.

This conventional solvent deasphalting method comprises deasphalting and solvent recovery. Formerly, the deasphalting was effected by a gravity precipitation system comprising mixing starting hydrocarbons with a solvent and then introducing the resulting mixture into multiple-stage settlers to separate the asphaltene, however, this system is low in separation efficiency; thus, at the present, the starting hydrocarbons are charged into an extraction tower (such as a baffle tower or rotary disc tower) at the top, while a solvent (such as propane, butane or pentane) is charged into the extraction tower at the portion near the bottom, and the hydrocarbons and solvent in the tower are heated to about 50°-200° C. under such a pressure that the solvent is prevented from evaporation at said temperature thereby to recover the deasphalted hydrocarbons with a part of the solvent from the tower at the top and the asphaltene with the remainder of the solvent therefrom at the bottom. This countercurrent extraction tower system is the most prevalently used and, further, similar systems of this type have been proposed and carried out. Furthermore, there are also known not only a forced separation system comprising mixing a heavy fraction oil with a solvent such as pentane or hexane, maintaining the resulting mixture at a suitable temperature and then separating the asphaltene from the oil, but also an electrostatic precipitation separation system comprising using a solvent mainly containing pentane in and applying an electric field to an asphaltene-containing oil in a settler thereby to increase the precipitation velocity of the asphaltene for the separation thereof. The aforementioned various solvent deasphalting systems are particularized in, for example, "Kagaku Kogyo (Chemical Industry), No. 12, pages 31-40, 1976".

However, the countercurrent extraction tower system is disadvantageous in that it requires a large amount of a solvent, it does not exhibit a satisfactorily high yield of a deasphalted oil and it needs a large-scale extraction tower thereby to raise problems as to its economy. Further, it needs a long treating time to separate asphaltene efficiently and also needs strict control of the flow rate, pressure and temperature of a starting oil to be deasphalted, this rendering the industrial operations complicated in many respects.

On the other hand, the forced separation system employing a hydrocyclone is effective in permitting the use of a miniaturized deasphalting apparatus, however, it needs a large-scale centrifuge to attain satisfactory separation efficiency thereby to raise problems as to economy and it is not applicable in a case where asphaltene to be separated is tacky whereby the degree of refining of deasphalted oil to be obtained is limited. In addition, the electrostatic precipitation separation system needs application of high electric voltage thereby raising problems as to practicability.

As mentioned above, the conventional known methods for solvent deasphalting of asphaltene-containing hydrocarbons have raised various problems as to their economy.

Thus, the present inventors made various studies in attempts to eliminate the aforesaid disadvantages of said conventional methods and, as a result of their studies, they accomplished this invention.

An object of this invention is to provide a continuous process for producing a desired deasphalted oil which is suitable for use as a starting oil in hydrolysis, fluidized catalytic cracking or the like and is obtained by removing harmful asphaltene which has a high content of metals and causes problems as to decreased catalytic activity, coking and the like in the refining step, from asphaltene-containing hydrocarbons in a short treating time, at a low cost and with satisfactory selectivity by the use of simple operations.

The object of this invention may be achieved by a process which comprises (I) mixing (A) 100 parts by weight of asphaltene-containing hydrocarbons with (B) 0.005-0.5 parts by weight of at least one member selected from amorphous silicon dioxides and silicate compounds and (C) 5-2000 parts by weight of at least one member selected from the following solvents (1)-(4):

(1) aliphatic and alicyclic hydrocarbons having 3-20 carbon atoms, (2) saturated aliphatic and saturated alicyclic monohydric alcohols having 1-10 carbon atoms, (3) liquid hydrogen disulfide and (4) liquuid carbon dioxide to form a mixture of the materials (A), (B) and (C) and then (II) making the thus formed mixture to stand still to precipitate and separate the asphaltene therefrom thereby obtaining a deasphalted oil. The mixing of the materials (A), (B) and (C) and the precipitation and separation. According to this invention, not only the mixing of the materials (A), (B) and (C) but also the precipitation and separation of asphaltene from said materials are continuously carried out thereby continuously obtaining a deasphalted oil.

The continuous process for solvent deasphalting asphaltene-containing hydrocarbons according to this invention will be explained in more detail hereunder.

The asphaltene-containing hydrocarbons used herein are various hydrocarbons containing usually 1–50 wt.%, preferably 3–30 wt.%, of asphaltene and they are exemplified by various oils obtained from oil shale, oil sand and tar sand, petroleum type crude oils, oils obtained by cracking said oils by any means, oils obtained by separating and removing a part or greater part of the light fraction from the aforementioned oils by means of distillation or the like, and mixtures thereof. Of these exemplified asphaltene-containing hydrocarbons, the preferred ones are a residual oil obtained at the time of atmospheric pressure distillation of a crude oil, a residual oil obtained at the time of reduced pressure distillation and a residual oil at the time of cracking each in the step of refining of petroleum.

The amorphous silicon dioxides (B) used in this invention are a non-crystalline and colorless, white or yellow-brown powder represented by the general formula $SiO_2$. These compounds are generally called silica, silica gel, white carbon or the like and may be a natural or synthetic one for the purpose of this invention. The compounds (B) used in this invention further include diatomaceous earth which is a kind of fossil formed by deposition of unicellular algae such as diatom on the bottom of the seas and lakes.

The amorphous silicon dioxides (B) used herein may be in the form of anhydride or hydrate. The compounds (B) in the hydrate form may have any optional water content, preferably an up to 20 wt.% water content and more preferably an up to 15 wt.% water content. In addition, the amorphous silicon dioxides (B) may have any optional particle size and surface area. The average particle size of primary particles of the compounds (B) may be preferably 0.5–1,000 mμ, more preferably 1–100 mμ. The term "primary particles" is intended to mean the minimum structural units of the compounds (B). Usually, several to several hundreds of the primary particles are chemically bonded together tridimensionally to form larger particles which are called secondary particles. The secondary particles may have a surface area of preferably 10–1,000 $m^2/g$, more preferably 50–800 $m^2/g$ and most preferably 100–800 $m^2/g$.

The amorphous silicon dioxide (B) used herein need not necessarily be pure, may contain $SiO_2$ in an amount by weight of at least 85% of the solid matter (except for water) thereof and may further contain $Al_2O_3$, $Fe_2O_3$, CaO, MgO and the like in a total amount by weight of up to 15%. Further, the compound (B) used herein may also be one having its surface changed in properties by being treated with a suitable inorganic or organic reagent, such as one having its surface impregnated with $Al_2O_3$ or covered with an alkyl group for making hydrophobic.

More specifically, the amorphous silicon dioxides (B) used herein include a series of silica (silica gel, white carbon) which are commercially available under the trade name of TOKAI GEL, FUJI GEL, SYLOID, HISHI GEL, SILBEED, DRY GEL, YAMANI, FINESIL, TOKUSIL, NISSIL, AEROSIL, NIPSIL, DIASIL, CARPLEX, SUNSILT, SILTON, STARSIL, VITASIL, ULTRASIL, DUROSIL, EXTRUSIL, VULKASIL, HI-SIL, ZEO, INSIL or the like and further include diatomaceous earth marketed under the trade name of KUNILITE, RADIOLITE and the like, as well as mixtures of said silica and diatomaceous earth.

The silicate compounds (B) used in this invention are expressed as water-containing silicate compounds in terms of oxides composition. More particularly, in terms of oxides composition, the silicate compounds (B) contain, as the essential components, (1) silicon dioxide ($SiO_2$), (2) at least one metal oxide selected from metal oxides represented by the general formulae $M(I)_2O$, M(II)O and $M(III)_2O_3$ wherein M(I) is a monovalent metal, M(II) is a divalent metal and M(III) is a trivalent metal, and (3) water ($H_2O$).

They are a solid compound at ambient temperature (20° C.) under atmospheric pressure (1 atm.) and may be used alone or in combination in the practice of this invention.

The metal oxides represented by the general formula $M(I)_2O$ are oxides of monovalent metals and typically include lithium oxide ($Li_2O$), sodium oxide ($Na_2O$) and potassium oxide ($K_2O$) with at least one of the last two oxides being preferred; the metal oxides represented by the general formula M(II)O are oxides of divalent metals and typically include beryllium oxide (BeO), magnesium oxide (MgO), calcium oxide (CaO), manganese oxide (MnO), ferrous oxide (FeO), cobalt oxide (CoO), zinc oxide (ZnO), cadmium oxide (CdO), lead oxide (PbO) and barium oxide (BaO) with at least one of magnesium oxide, calcium oxide and ferrous oxide being preferred; and the metal oxides represented by the general formula $M(III)_2O_3$ are oxides of trivalent metals and typically include boron oxide ($B_2O_3$), aluminum oxide ($Al_2O_3$), ferric oxide ($Fe_2O_3$) and chromium oxide ($Cr_2O_3$) with at least one of aluminum oxide and ferric oxide being preferred. The term "water" of the said water-containing silicate compounds is intended herein to mean not only coordinate water (water coordinated with metallic ion to form complex ion) but also anion water (water securely bonded to anion by hydrogen bonding), lattice water (water which is not coordinated but present in a fixed proportion to fill the voids of crystal lattice therewith), water of constitution (water contained as OH group or groups) and zeolite water (water which fills the voids of lattice as water molecules like lattice water but will not essentially change the crystal structure even if dehydrated).

The silicate compounds (B), in terms of oxides composition, may contain not only said essential components (1), (2) and (3), but also (4) other compounds such as oxides (illustrated by titanium oxide ($TiO_2$), zirconium oxide ($ZrO_2$), hefnium oxide ($HfO_2$) and phosphorus pentoxide ($P_2O_5$)), fluorides (represented by the formula M(I)F or $M(II)F_2$), chlorides (represented by the formula M(I)Cl or $M(II)Cl_2$), sulfates (represented by the formula $M(I)_2SO_4$ or $M(II)SO_4$ and mixtures thereof. In said formulae, M(I) and M(II) indicate a monovalent metal and a divalent metal, respectively.

Assuming that the said compound or compounds other than the essential components are expressed as "X" for convenience' sake, the silicate compounds (B) expressed in terms of oxides composition (the index number for $SiO_2$ being 1) include the following compounds:

(a) $SiO_2.aM(I)_2O.bH_2O.tX$, (b) $SiO_2.cM(II)O.dH_2O.uX$, (c) $SiO_2.eM(III)_2O_3.fH_2O.vX$, (d) $SiO_2.gM(I)_2O.hM(II)O.iH_2O.wX$, (e) $SiO_2.jM(I)_2O.kM(III)_2O_3.lH_2O.xX$,
(f) $SiO_2.mM(II)O.nM(III)_2O_3.oH_2O.yX$,
(g) $SiO_2.pM(I)_2O.qM(II)O.rM(III)_2O_3.sH_2O.zX$ and
(h) mixtures thereof wherein a to s are each a numeral larger than zero (>0) and t to z are each a numeral larger than or equal to zero (≧0).

In the silicate compounds (B) in terms of oxides composition, the ratios by weight of the essential silicon dioxide (1), metal oxide or oxides (2) and water (3), to the whole of the silicate compound (B) are not limited but are preferably in the range of (1) 10–85%, (2) 10–80% and (3) 0.1–50% respectively and more preferably in the range of (1) 20–75%, (2) 20–70% and (3) (ignition loss) 0.5–40% respectively. In addition, the ratio by weight of the optional component (4) other than the essential components to the whole of the compound (B) is not limited but is preferably up to 30%, more preferably up to 20%.

The silicate compounds (B) may be natural or synthetic ones or mixtures thereof.

The silicate compounds (B) used herein include, for example, humite group minerals (norbergite, condrodite, humite, clinohumite, etc.), datolite, staurolite, chloritoid, epidote group minerals (zoisite, epidote (clinozoisite, pistacite), piedmontite, allanite, etc.), lawsonite, pumpellyite, vesuvianite (idocrase), tourmaline group minerals (dravite, schol, elbaite, etc.), hydrous cordierite, amphibole group minerals (anthophyllite, gedrite, cummingtonite, grunnerite, tremolite, actinolite, tschermakite, ferrotschermakite, edenite, ferroedenite, pargasite, ferrohastingsite, hornblende, glaucophane, riebeckite, magnesioriebeckite, arfvedsonite, magnesioarfvedsonite, katophorite, magnesiokatophorite, etc.), attapulgite (palygroskite), vermiculite, mica group minerals (lepidolite, muscovite, lepidomelane, paragonite, phlogopite, margarite, sericite, illite, biotite, etc.), pyrophyllite, talc, glauconite, chlorite group minerals (penninite, leuchtenbergite, prochlorite, etc.), septechlorite group minerals (amesite, chamosite, greenalite, cronstedtite, etc.), hydralsite, serpentine group minerals (chrysotile, antigorite, lizardite, etc.), stilpnomelane, allophane, kaolin group minerals (kalinite, dickite, nacrite, halloysite, mesohalloysite, montmorillonite group minerals (montmorillonite, nontronite, saponite, beidellite, sauconite, etc.), dumortierite, prehnite and zeolite group minerals (natrolite, mesolite, scolecite, thomsonite, heulandite, stilbite, epistilbite, analcite, harmotome, phillipsite, chabazite, gmelinite, laumontite, wairakite, clinoptilolite, D'achiardite, gonnardite, mordenite and yugawaralite). These silicate compounds may be used alone or in combination.

The silicate compounds (B) used herein further include soil-like aggregate consisting mainly of naturally occurring fine silicate compounds, which aggregate is generally called clay (clay, terra alba, potter's clay, catalpo). The clay contains as the main components or at least 50%, preferably 70%, by weight of said mica group minerals, pyrophyllite, talc, chlorite group minerals, serpentine group minerals, kaolin group minerals, montmorillonite group minerals and the like. Depending on the utility, post-fire properties, origin, geological origin, geographical situation, tissue and certain specific properties of clay as well as on foreign matters or impurities contained therein, the clay is called kaolin (feldspathic kaolin, micaceous kaolin, alkaline kaolin, ferrokaolin, china clay or the like), plastic clay (ball clay or the like), fire clay, flint clay, refractory clay, slip clay (shale clay, glacial clay or the like), enamel clay, montmorillonite type clay (bentonite, Fuller's earth or the like), sericite type clay or the like), pagodite type clay or the like. These clays may be used alone or in combination as the silicate compound (B) according to this invention.

Synthetic silicates produced by various synthesizing processes may also be used as the silicate compounds (B) according to this invention and they include, for example, synthetic magnesium silicate, synthetic calcium silicate, synthetic aluminum silicate and synthetic zeolite.

There have so far been described the various silicate compounds usable as the silicate compounds (B) according to this invention, among which are preferred attapulgite, vermiculite, mica group minerals, pyrophyllite, talc, glauconite, chlorite group minerals, septechlorite group minerals, hydralsite, serpentine group minerals, stilpnomelane, allophane, kaolin group minerals, montmorillonite group minerals, zeolite group minerals, various kinds of clay, synthetic calcium silicate, synthetic aluminum silicate and synthetic zeolite with mica group minerals, pyrophyllite, talc, glauconite, chlorite group minerals, kaolin group minerals, kaolin group minerals, montmorillonite group minerals, various kinds of clay, synthetic calcium silicate and synthetic aluminum silicate being particularly preferred.

The particle size of the silicate compounds (B) is optional, however, the average particle size thereof may be preferably 0.01μ–1.0 mm, more preferably 0.1μ–500μ and most preferably 0.5μ–200μ.

Prior to mixing with the materials (A) and (C), the silicate compounds (B) may be baked to decrease the water content thereof and increase the activity thereof or may be treated on the surface with a suitable inorganic or organic reagent to change the surface properties; for example, they may be reformed on the surface with a silane type coupling agent or treated with an organic base to form an organic composite. Thus, the silicate compounds (B) so baked or treated are also effectively usable as the material (B).

The silicate compounds (B) further include, for example, synthetic silicates which are commercially available respectively under the trade names of SILMOS, STARLEX, SOLEX, FRICSIL, SERIKRON, CALSIL and ZEOLEX; clay (including fired clay, silane reformed clay and a clay-organic composite) which is commercially available under the trade name of BENGEL, WINNER CLAY, SUPERLITE, KUNIGEL, KUNIPIA, KUNIBOND, NEOSUPER, SWANY, HARD TOP CLAY, SILCALITE, HARDBRIGHT, HARDSIL, SERIKRON, SERIMIN, FUBASAMI CLAY, OSMOS, ORBEN, ORGANITE, S-BEN, OPTIWHITE, ICECAP, THERMOGLACE, HYDRITE, SUPREX, POLYFIL, PYRAX, NULOK, NUCAP, BURGESS or TRANSLINK; talc which is commercially available under the trade name of KUNIMINE TALC, NITRON, HITRON, SIMGON, MISTRON VAPOR, BEAVERWHITE, ASBESTINE or LOOMITE; mica marketed under the trade name of MICROMICA or WET GROUND MICA; and mixtures thereof.

The solvent (C) used in this invention is at least one member selected from (1) aliphatic or alicyclic hydrocarbons having 3–20 carbon atoms, preferably 3–8 carbon atoms, (2) saturated aliphatic or saturated alicyclic monohydric alcohols having 1–10 carbon atoms, preferably 1–5 carbon atoms, (3) liquid hydrogen sulfides and (4) liquid carbon dioxide.

The aliphatic or alicyclic hydrocarbons (C) (1) may be saturated or unsaturated hydrocarbons, and the aliphatic hydrocarbons may be a straight-chain or branched hydrocarbon. The saturated aliphatic hydrocarbons used herein include, for example, propane, n-butane, methylpropane, n-pentane, methylbutane, ethylpropane, n-hexane, n-heptane, n-octane, n-nonane, n-decane, 2,3-diethylhexane, 2,3,5-trimethylheptane, n-dodecane, 3-ethyl-5-butyloctane, n-pentadecane, 3-butyl-6-methyldecane, n-octadecane and n-nonadecane. The saturated alicyclic hydrocarbons include, for example, cyclopentane, cyclohexane, decalin, 2-methyldecalin, heptylcyclohexane, octylcyclohexane and dodecylcyclopentane. The unsaturated aliphatic hydrocarbons include, for example, 1-butene, 1-pentene, 1-hexene, 2-methyl-1-pentene, 1-heptene, 3-ethyl-1-pentene, 1-octene, 3-methyl-1-octene and 1-decene. The unsaturated alicyclic hydrocarbons include, for example, cyclopentene, cyclohexene, 2-methylcyclohexene, 2-ethylcyclopentene, 2-propylcyclopentene, 2-butylcyclopentene and octahydronaphthalene.

The solvents (C) (1) are illustrated by the aforesaid hydrocarbons and mixtures thereof, and the preferred ones are propane, n-butane, n-heptane, n-hexane, n-heptane, cyclopentane, cyclohexane, cyclopentene, cyclohexene, 2-methylcyclohexene and mixtures thereof.

The solvents (C) (1) used herein also include LPG fractions, light gasoline fractions, heavy gasoline fractions and kerosene fractions, each obtained by the distillation of crude oils at atmospheric pressure, these fractions being each a mixture of the abovementioned various hydrocarbons.

The saturated aliphatic and alicyclic monohydric alcohols (C) (2) include, for example, methanol, ethanol, n-propanol, isopropanol, n-butanol, n-pentanol, n-hexanol, n-heptanol, n-octanol, cyclopentanol, cyclohexanol and mixtures thereof with n-propanol, isopropanol, n-butanol, n-pentanol and mixtures thereof being preferred.

The solvents (C) which are at least one member selected from the above-mentioned hydrocarbons (1) and alcohols (2) as well as liquid hydrogen sulfide (3) and liquid carbon dioxide, may be pure or may contain a small amount of impurities such as water. They may be used alone or in combination. The solvents which may preferably be used alone include propane, n-butane, n-pentane, n-hexane, n-heptane, n-propanol, isopropanol and n-butanol. The solvents which may preferably be used in combination are a mixture of a saturated aliphatic hydrocarbon selected from propane, n-butane and n-pentane with a saturated aliphatic monohydric alcohol selected from n-propanol, isopropanol and n-butanol, with a mixture of n-pentane with n-butanol being especially preferred.

The amount of the amorphous silicon dioxide (B) and/or the silicate compound (B) added to the asphaltene-containing hydrocarbons (A) in this invention is 0.005–0.5 parts, preferably 0.01–0.3 parts and more preferably 0.01–0.2 parts by weight per 100 parts by weight of hydrocarbons (A). It is apparent from the Examples and Comparative Examples that the use of the ingredient (B) in an amount by weight of more than 0.5% will result in exhibiting much inferior effects to the use thereof in an amount specified in this invention. It is one of the features of this invention to enable the asphaltene to be removed from the asphaltene-containing hydrocarbons efficiently in a sufficiently short time only by adding such a small amount of the amorphous silicon oxide or the silicate compound to the asphaltene-containing hydrocarbons.

The term "compound (B)" is hereinafter intended to mean the amorphous silicon dioxide (B) and/or the silicate compound (B).

On the other hand, the amount of the solvent (C) added to the asphaltene-containing hydrocarbons (A) is 50–2,000, preferably 100–1,000 and more preferably 200–800 parts by weight per 100 parts by weight of the asphaltene-containing hydrocarbons (A).

According to this invention, the asphaltene-containing hydrocarbons (A) are mixed with the compound (B) and the solvent (C) to rapidly precipitate and remove the asphaltene from the hydrocarbons (A). It is preferable to allow the resulting mixture to stand still until it has been separated industrially and easily into the substantially asphaltene-free hydrocarbons (hereinafter referred to as "deasphalted oil") and the asphaltene precipitated and removed.

In the practice of this invention, separation systems of any conventional kind may be used without need of designing and constructing new systems for solvent deasphalting. This invention may be carried out by the use of a conventionally-used extraction type, forced separation type or like type solvent deasphalting system thereby to obtain, as compared with conventional systems, remarkable effects such as the improvement of asphaltene removal efficiency and the shortening of time needed for the separation. In a case where this invention is practiced by the use of a solvent deasphalting system using countercurrent extraction tower, there are obtained effects such as the prevention of flooding which may otherwise be caused in, for example, the baffle tower, rotary disc tower in the extraction type system and the reduction of amount of a solvent used as compared with the conventional systems. Further, in a case where this invention is carried out by the use of a forced separation type solvent deasphalting system, there is effective in greatly reducing the load of the forced separator used.

As is mentioned above, this invention may be easily carried out with excellent effects being obtained even by the use of the conventional solvent deasphalting system. It is desirable, however, to use a simple system without such countercurrent extraction towers, forced separators and the like in order to make the best use of the advantages of this invention. Therefore, the most preferable system for carrying out this invention is a gravity precipitation type solvent deasphalting system in which the separation of asphaltene is continuously effected only by settlers. It will be impossible to effect precipitation separation of asphaltene by allowing asphaltene-containing hydrocarbons to stand still if the conventional systems are used; for this reason, the conventional systems need the countercurrent extraction towers, cyclones and forced separators such as centrifuges. In contrast, this invention enables such precipitation separation of asphaltene to be easily effected since the asphaltene is rapidly precipitated for its separation from asphaltene-containing hydrocarbons according to this invention. According to this invention, wholesale installations such as countercurrent extraction towers and forced separators, can be dispensed with to effect a process for the solvent deasphalting of asphaltene-containing hydrocarbons, whereby the process is greatly enhanced in economy.

In this invention, the compound (B) and the solvent (C) may be added to the asphaltene-containing hydrocarbons in any order and in any way. It is possible to add the compound (B) to the hydrocarbons and then add the solvent thereto by means of line mixing or the like, however, it is preferable from the view-point of separation efficiency to add the compound (B) and the solvent (C) at the same time to the hydrocarbons or to add the solvent and then the compound (B) to the hydrocarbons. In a case where the compound (B) and the solvent (C) are attempted to be added at the same time to the hydrocarbons, these compound (B) and solvent (C) may be added through their respective lines to the hydrocarbons or may be mixed together for subsequent addition of the resulting mixture to the hydrocarbons. Further, the compound (B) may be added in two portions, one portion being added together with the solvent and the other being added downstream of the line to promote precipitation of the asphaltene.

In a case where this invention is carried out by a gravity precipitation type solvent deasphalting process, it is preferable that either the asphaltene-containing hydrocarbons, compound (B) and solvent are mixed together on a mixer to form a mixture or the compound (B) is mixed firstly with the solvent and secondly with the hydrocarbons to form a mixture and then the thus formed mixture is introduced into settlers where it is allowed to stand still for precipitation and separation of the asphaltene from the mixture. It is also preferable that the asphaltene-containing hydrocarbons and the solvent are mixed together by a mixer, line mixing or the like, the resulting mixture is charged into a settler and the compound (B) is then added to the mixture in the settler.

In a case where this invention is effected by a solvent deasphalting system using countercurrent extraction tower, it is preferable that a line for feeding the compound (B) is connected to a line for feeding the solvent thereby to form a mixture of the solvent and compound (B), and the resulting mixture is then introduced into the extraction tower at the bottom since this procedure can dispense with wholesale reconstruction of the existing installations for effecting the solvent deasphalting. Further, in a case where this invention is carried out by a forced separation type solvent deasphalting process, it is preferable that either a line for feeding the compound (B) is connected to a line for feeding the solvent thereby to form a solvent-compound (B) mixture which is then mixed with the hydrocarbons to form a three-component mixture, or the hydrocarbons, compound (B) and solvent are mixed together on a mixer to form a three-component mixture, and the three-component mixture is then introduced into a forced separator for separation.

In one embodiment of this invention, the asphaltene-containing hydrocarbons are subjected to primary asphaltene separation by the use of a conventional solvent deasphalting process using a countercurrent extraction tower or forced separator, a deasphalted oil-solvent mixture from the tower or separator is incorporated with the compound (B) to separate the asphaltene still remaining in said mixture and the compound (B)-incorporated mixture is then introduced into settlers for effecting secondary separation of asphaltene. It is also possible to further add the compound (B) at the time of primary separation in accordance with this invention.

The temperature used in the process of this invention varies depending on the kind of the solvent (C) used. The use of too low a temperature will result in deteriorating the fluidity of asphaltene-containing hydrocarbons to be treated and rendering it difficult to handle the asphaltene separated, the use of too high a temperature will result in not only requiring a high pressure to prevent evaporation of the solvent but also tending to cause condensation reactions and polymerization reactions; this is undesirable for the process of this invention. Thus, in general, the temperature used in the present process for a time from the addition of the compound (B) and solvent (C) to the separation of the asphaltene is in the range of preferably 0°-300° C., more preferably 20°-250° C. and most preferably 40°-200° C. It is also possible in this invention to promote precipitation of the asphaltene by adding the compound (B) and solvent to the asphaltene-containing hydrocarbons and then heating the resulting mixture to within said temperature range. In addition, the lower limit of the pressure used in this invention should be such that the solvent is not evaporated; however, it is generally in the range of preferably 0.5-150 $Kg/cm^2$, more preferably atmospheric pressure up to 80 $Kg/cm^2$ and most preferably atmospheric pressure up to 50 $Kg/cm^2$.

The oil-solvent mixture from which the asphaltene has been removed in the countercurrent extraction tower, forced separator or the like, is passed to a solvent recovery unit if necessary. This oil-solvent mixture may be treated in any way to recover the solvent therefrom and conventional solvent recovery units may be used for this recovery purpose. Deasphalted oils obtained by removing the solvent from the oil-solvent mixture may usually be used as a starting oil to be treated in the subsequent step of petroleum refining such as fluidized catalytic cracking, hydrogenolysis, hydrodesulfurization or the like.

On the other hand, it is also possible to recover the solvent which is contained in the asphaltene separated in the countercurrent extraction tower, forced separator or the like, by any optional solvent recovery unit if necessary. The asphaltene so obtained may be mixed with, for example, a heavy oil for use as fuel and may also be used as a blending material for asphalt or as a material for activated carbon and the like.

Figure 2:
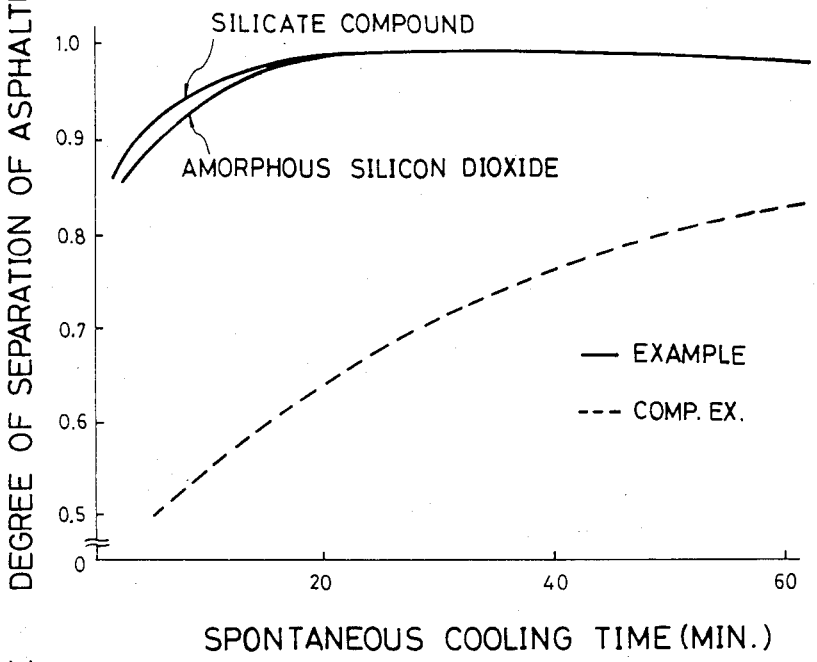
Figure 3:
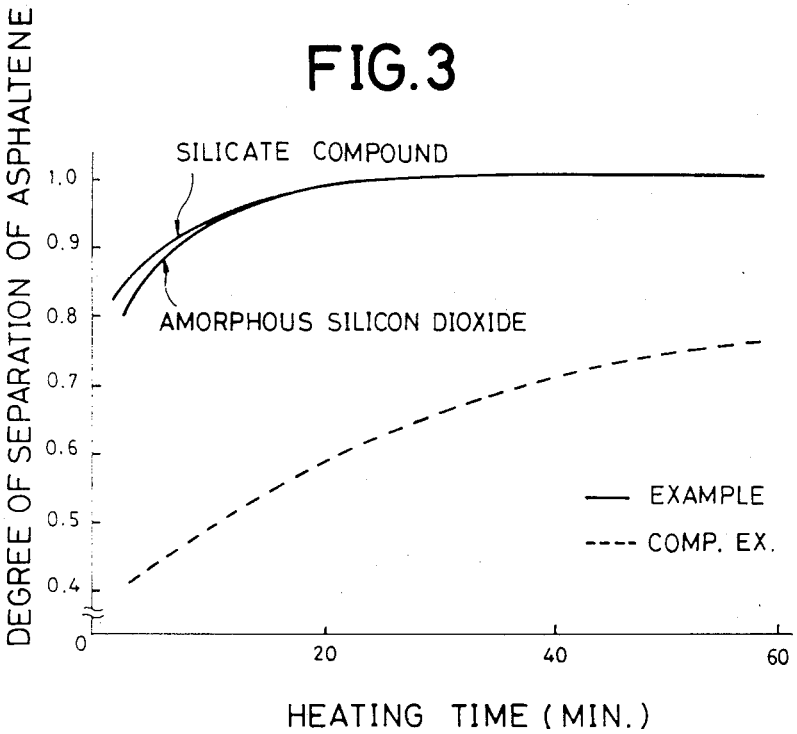

This invention will be better understood by reference to the accompanying drawings in which:

FIG. 1 is a flow sheet of a preferable process for solvent deasphalting asphaltene-containing hydrocarbons in accordance with this invention;

FIG. 2 indicates the relationship between the time needed for allowing a mixture according to this invention to cool and the degree of separation of asphaltene in the case of each of the following Examples and Comparative Examples in which is used the same fixed time for heating the mixture; and FIG. 3 indicates the relationship between the time for heating a mixture according to this invention and the degree of separation of asphaltene in the case of each of the following Examples and Comparative Examples in which is used the same fixed time for allowing the mixture to cool.

Referring now to FIG. 1, asphaltene-containing hydrocarbons to be treated is charged through a line 1 to a mixer A where they are mixed with an amorphous silicon dioxide and/or silicate compound (compound (B)) and a solvent supplied to the mixer A respectively through lines 2 and 3 thereby to form a mixture. To promote precipitation of the asphaltene, the thus formed mixture is passed through a line 4 to a heater B by which the mixture is heated to a predetermined temperature selected depending on the kind of the solvent used and under such a pressure that the solvent does not boil at the predetermined temperature, after which the mixture so heated is charged into a settler C. The mixture is allowed to stand still in the settler for a fixed time, preferably for 10 minutes to one hour whereby the asphaltene is precipitated and removed. It is possible at this time to further supply the metal compound through a line 5 in order to accelerate precipitation of the asphaltene. Not only a single settler but also a series of settlers may be used as required. After the asphaltene is removed by precipitation in this manner, the resulting deasphalted oil-solvent mixture present in the upper portion of the settler is passed through a line 6 to a solvent recovery unit D for removing the solvent from the mixture and the deasphalted oil obtained is then recovered through a line 7. On the other hand, the asphaltene precipitated in the lower portion of the settler is recovered through a line 9. In a case where the asphaltene contains a large amount of the solvent, it is passed through a line 10 to a solvent recovery unit E for removing the solvent therefrom and then recovered through a line 11. The solvent recovered at the solvent recovery units D and E is recycled to the mixer A respectively through the line 8 and a line 12 and further through a line 3. At this time a fresh solvent may be supplied through a line 13 as required.

The operational conditions of the process as illustrated in FIG. 1 will depend greatly on the kind of a solvent used. For example, in a case where n-heptane is used as the solvent, the process may be effected at atmospheric pressure and preferably 60°–100° C. by the use of the heater.

This invention will be further better understood by reference to FIG. 1 and the following non-limitative Examples in comparison with Comparative Examples.

The properties of various commercially available amorphous silicon dioxides used in Examples 1–12 and Comparative Examples 1–4 are summarized as shown in Table 1.

TABLE 1

| Amorphous silicon dioxide | Surface area of secondary particles ($m^2/g$) | $SiO_2$ content of dry particles (wt. %) | Ignition loss (wt. %) | Remarks |
|---|---|---|---|---|
| B-1 | 380 | >99.8 | <2 | Silica |
| B-2 | 300 | >99.8 | <2.5 | Silica |
| B-3 | 170 | >98.3 | <1 | Silica |
| | | | | (Particles impregnated on the surface with $Al_2O_3$.) |
| B-4 | 120 | >98.3 | <2 | Silica |
| | | | | (Methylated on the surface to make hydrophobic.) |
| B-5 | 170–220 | 93–94 | 5–6 | Silica |
| B-6 | 150–220 | 85–90 | 9–14 | Silica |
| B-7 | 270 | 99.3 | 4 | Silica |
| B-8 | 30–40 | 90.6 | <1 | Diatomaceous earth |

EXAMPLES 1–12 AND COMPARATIVE EXAMPLES 1–4

In Examples 1–10, using the process as shown in FIG. 1, the following experiments were made to produce deasphalted oils from an asphaltene-containing residual oil obtained by the distillation of Arabian light crude oil at a reduced pressure, the properties of the residual oil being as shown in Table 2.

A starting oil which was the residual oil, and n-heptane as a solvent, were charged at 1.0 Kg/hr and 4.0 Kg/hr through lines 1 and 3 into a mixer A, respectively. The materials so charged in the mixer were thoroughly mixed together at room temperature (25° C.) and atmospheric pressure and then incorporated through a line 2 with amorphous silicon dioxide in each of such amounts as indicated in Table 3 to obtain a liquid mixture. The thus obtained liquid mixtures were each heated to 90° C. with steam in a heater B and then introduced into a settler C where the asphaltene was precipitated and separated therefrom. Then, the deasphalted oil-solvent mixture was passed through a line 6 to a solvent recovery unit D to separate the solvent from the mixture thereby obtaining through a line 7 0.86 Kg/hr of a deasphalted oil the properties of which are as indicated in Table 3. The overall treating time was about 30 minutes and the residence time of the liquid mixture in the settler was about 20 minutes.

In Example 11, the procedure of Examples 1–10 was followed except that an asphaltene-containing residual oil (the properties of which are as shown in Table 4) obtained by the distillation of Kafji crude oil at atmospheric pressure was substituted for the aforesaid residual oil obtained from Arabian light crude oil. In Example 12, the procedure of Examples 1–10 was follwed except that n-pentane was substituted for the n-heptane as the solvent and the process conditions were 150° C. and 20 $Kg/cm^2$.

For comparison, in Comparative Example 1 the procedure of Examples 1–10 was followed except that amorphous silicon dioxide was not used, and in each of Comparative Examples 2–4 the same procedure was followed except that amorphous silicon dioxide was used in a larger amount than specified in the present invention.

The results are as indicated in Table 3.

TABLE 2

| | | |
|---|---|---|
| Yield of residual oil, based on crude oil (wt. %) | | 25.8 |
| Specific gravity (15/4° C.) | | 1.003 |
| Residual carbon (wt. %) | | 18.16 |
| Ash (wt. %) | | 0.015 |
| Metal content (ppm) | V | 98.2 |
| | Ni | 30.1 |
| H/C ratio (mol) | | 1.40 |
| Analysis composition (wt. %) | Saturated ingredients | 18.2 |
| | Aromatic ingredients | 52.5 |
| | Resinous ingredients | 23.3 |
| | Asphaltene | 6.0 |

TABLE 3

| | Amorphous silicon dioxide | | | Conditions | | Properties of deasphalted oil | | |
|---|---|---|---|---|---|---|---|---|
| | Type | Amount in wt. % (based on the weight of starting oil) | Solvent | Temp. (°C.) | Pressure | Metal ingredients (ppm) V | Metal ingredients (ppm) Ni | Analysis Asphaltene (wt. %) |
| Example 1 | B-1 | 0.40 | n-heptane | 25 | atmospheric pressure | 13 | 3 | <0.01 |
| Example 2 | " | 0.10 | n-heptane | " | atmospheric pressure | 12 | 3 | <0.01 |
| Example 3 | " | 0.05 | n-heptane | " | atmospheric pressure | 12 | 3 | <0.01 |
| Comparative Example 1 | — | — | n-heptane | " | atmospheric pressure | 68 | 21 | 3.7 |
| Comparative Example 2 | B-1 | 4.00 | n-heptane | " | atmospheric pressure | 30 | 10 | 0.5 |
| Example 4 | B-2 | 0.15 | n-heptane | " | atmospheric pressure | 14 | 4 | 0.05 |
| Comparative Example 3 | " | 3.50 | n-heptane | " | atmospheric pressure | 32 | 11 | 0.5 |
| Example 5 | B-3 | 0.20 | n-heptane | " | atmospheric pressure | 13 | 3 | <0.01 |
| Example 6 | B-4 | 0.46 | n-heptane | " | atmospheric pressure | 16 | 5 | 0.01 |
| Example 7 | B-5 | 0.01 | n-heptane | " | atmospheric pressure | 15 | 5 | 0.01 |
| Example 8 | B-6 | 0.31 | n-heptane | " | atmospheric pressure | 15 | 5 | 0.01 |
| Example 9 | B-7 | 0.008 | n-heptane | " | atmospheric pressure | 13 | 3 | <0.01 |
| Comparative Example 4 | " | 2.80 | n-heptane | " | atmospheric pressure | 27 | 10 | 0.4 |
| Example 10 | B-8 | 0.10 | n-heptane | " | atmospheric pressure | 16 | 5 | 0.01 |
| Example 11[1] | B-7 | 0.07 | n-heptane | " | atmospheric pressure | 19 | 6 | 0.05 |
| Example 12 | B-1 | 0.007 | n-pentane | 150 | 20 kg/cm$^2$ | 10 | 2 | 0 |

note
[1]A residual oil (the properties thereof being as shown in Table 4) obtained by distillation of Kafji crude oil at atmospheric pressure was used.

TABLE 4

| | | |
|---|---|---|
| Yield of residual oil (wt. %, based on crude oil) | | 55.2 |
| Specific gravity (15/4° C.) | | 0.9821 |
| Residual carbon (wt. %) | | 13.73 |
| Ash (wt. %) | | 0.027 |
| Metal ingredient | V | 97.3 |
| | Ni | 31.3 |
| H/C ratio (mol) | | 1.50 |

TABLE 4-continued

| | | |
|---|---|---|
| Analysis of composition (wt. %) | Saturated ingredients | 26.8 |
| | Aromatic ingredients | 48.4 |
| | Resinous ingredients | 11.3 |
| | Asphaltene | 13.5 |

The properties of arious silicate compounds (B) used in Examples 13–34 and Comparative Examples 5–7 are as indicated in Table 5.

TABLE 5

| Silicate compound | Average particle size (μ) | Oxides composition (wt. %) $SiO_2$ | $K_2O$ | $Na_2O$ | MgO | FeO | CaO | $Al_2O_3$ | $Fe_2O_3$ | Ignition loss | Remarks |
|---|---|---|---|---|---|---|---|---|---|---|---|
| B-9 | 10 | 57.5 | — | — | 1.7 | — | 20.3 | 0.9 | — | 20.3 | Synthetic calcium silicate |
| B-10 | 17 | 50.7 | 0.7 | 1.3 | 0.2 | — | 0.2 | 35.9 | — | 11.5 | Synthetic aluminum silicate |

TABLE 5-continued

| Silicate compound | Average particle size (μ) | Oxides composition (wt. %) | | | | | | | | | Remarks |
|---|---|---|---|---|---|---|---|---|---|---|---|
| | | $SiO_2$ | $K_2O$ | $Na_2O$ | MgO | FeO | CaO | $Al_2O_3$ | $Fe_2O_3$ | Ignition loss | |
| B-11 | 8.4 | 47.9 | 9.8 | 0.8 | 0.7 | — | 0.5 | 33.1 | 2.0 | 4.9 | Muscovite Powder |
| B-12 | 153 | 65.8 | 0.1 | 0.5 | 0.5 | — | 0.8 | 27.7 | trace | 5.0 | Pyrophyllite powder |
| B-13 | 4.0 | 61.9 | — | — | 30.1 | 0.3 | 1.8 | 1.7 | 0.8 | 5.9 | Talc powder |
| B-14 | 102 | 51.6 | 6.8 | 0.7 | 3.7 | 2.8 | 0.4 | 5.0 | 23.1 | 6.3 | Glauconite powder |
| B-15 | 89 | 36.4 | 0.2 | 0.1 | 37.9 | 2.1 | trace | 8.5 | 1.2 | 13.0 | Chlorite powder |
| B-16 | 130 | 38.8 | — | — | 38.3 | — | 1.6 | 1.4 | 9.1 | 10.9 | Serpentine jade powder |
| B-17 | 76 | 43.4 | 0.1 | 0.2 | trace | — | 0.7 | 39.7 | 0.8 | 15.2 | Kaolin powder |
| B-18 | 65 | 72.8 | 0.2 | 2.5 | 1.5 | trace | 0.5 | 15.1 | 0.8 | 6.6 | Montmorillonite powder |
| B-19 | 112 | 74.3 | 1.6 | 1.4 | 0.5 | — | 2.2 | 12.7 | 1.2 | 5.3 | Zeolite powder |
| B-20 | 57 | 43.4 | 0.1 | 0.2 | trace | — | 0.7 | 39.7 | 0.8 | 15.2 | Kaolin type clay |
| B-21 | 80 | 46.7 | 0.3 | 0.8 | 0.4 | — | 0.8 | 32.5 | 0.6 | 18.8 | Plastic clay (Ball clay) |
| B-22 | 165 | 45.6 | — | — | 0.1 | — | 0.3 | 36.4 | 3.3 | 14.8 | Shale clay |
| B-23 | 120 | 62.8 | 0.7 | 0.2 | 3.1 | — | 2.4 | 10.4 | 2.5 | 14.1 | Montmorillonite type clay |
| B-24 | 73 | 58.8 | 0.8 | 3.4 | 1.3 | — | 0.7 | 14.3 | 3.0 | 17.1 | Montmorillonite type clay (Bentonite) |
| B-25 | 1.3 | 51.6 | 1.1 | 0.3 | 1.0 | trace | 2.3 | 42.3 | trace | 1.2 | Fired clay |
| B-26 | 6.1 | 70.5 | 0.7 | 0.8 | 0.2 | — | 0.9 | 15.3 | 1.3 | 6.7 | Montmorillonite-organic composite |

EXAMPLES 13–34 AND COMPARATIVE EXAMPLES 5–7

In Examples 13–34, using the process as shown in FIG. 1, the following experiments were made to produce deasphalted oils from an asphaltene-containing residual oil obtained by the distillation of Arabian light crude oil at a reduced pressure, the properties of the residual oil being as shown in Table 2.

A starting oil which was the residual oil, and n-heptane as a solvent, were charged at 1.0 Kg/hr and 4.0 Kg/hr through lines 1 and 3 into a mixer A, respectively. The materials so charged in the mixer were thoroughly mixed together at room temperature (25° C.) and atmospheric pressure and then incorporated through a line 2 with silicate compound in each of such amounts as indicated in Table 6 to obtain a liquid mixture. The thus obtained liquid mixtures were each heated to 90° C. with steam in a heater B and then introduced into a settler C where the asphaltene was precipitated and separated therefrom. Then, the deasphalted oil-solvent mixture was passed through a line 6 to a solvent recovery unit D to separate the solvent from the mixture thereby obtaining through a line 7 0.89 Kg/hr of a deasphalted oil the properties of which are as indicated in Table 6. The overall treating time was about 30 minutes and the residence time of the liquid mixture in the settler was about 20 minutes.

In Example 33, the procedure of Examples 13–32 was followed except that an asphaltene-containing residual oil (the properties of which are as shown in Table 4) obtained by the distillation of Kafji crude oil at atmospheric pressure was substituted for the aforesaid residual oil obtained from Arabian light crude oil. In Example 34, the procedure of Examples 13–32 was followed except that n-pentane was substituted for the n-heptane as the solvent and the process conditions were 150° C. and 20 Kg/cm$^2$.

For comparison, in Comparative Example 5 the procedure of Examples 13–32 was followed except that silicate compounds was not used, and in each of Comparative Examples 6–7 the same procedure was followed except that silicate compound was used in a larger amount than specified in the present invention.

The results are as indicated in Table 6.

TABLE 6

| | Silicate compounds | | | Conditions | | Properties of deasphalted oil | | |
|---|---|---|---|---|---|---|---|---|
| | Type | Amount in wt. % (based on the weight of starting oil) | Solvent | Temp. (°C.) | Pressure | Metal ingredients (ppm) V | Metal ingredients (ppm) Ni | Analysis Asphaltene (wt. %) |
| Example 13 | B-9 | 0.05 | n-heptane | 25 | atmospheric pressure | 32 | 10 | 0.1 |
| Example 14 | " | 0.10 | n-heptane | " | atmospheric pressure | 30 | 9 | 0.05 |
| Example 15 | " | 0.42 | n-heptane | " | atmospheric pressure | 35 | 13 | 0.1 |
| Comparative Example 5 | — | — | n-heptane | " | atmospheric pressure | 72 | 24 | 6.5 |
| Comparative Example 6 | B-9 | 4.00 | n-heptane | " | atmospheric | 42 | 17 | 0.5 |

TABLE 6-continued

| | Silicate compounds | | | Conditions | | Properties of deasphalted oil | | |
|---|---|---|---|---|---|---|---|---|
| | Type | Amount in wt. % (based on the weight of starting oil) | Solvent | Temp. (°C.) | Pressure | Metal ingredients (ppm) V | Ni | Analysis Asphaltene (wt. %) |
| Example 16 | B-10 | 0.31 | n-heptane | " | pressure atmospheric pressure | 31 | 9 | 0.05 |
| Comparative Example 7 | " | 4.90 | n-heptane | " | atmospheric pressure | 40 | 15 | 0.4 |
| Example 17 | B-11 | 0.35 | n-heptane | " | atmospheric pressure | 33 | 11 | 0.15 |
| Example 18 | B-12 | 0.08 | n-heptane | " | atmospheric pressure | 32 | 10 | 0.1 |
| Example 19 | B-13 | 0.15 | n-heptane | " | atmospheric pressure | 31 | 10 | 0.1 |
| Example 20 | B-14 | 0.41 | n-heptane | " | atmospheric pressure | 36 | 12 | 0.2 |
| Example 21 | B-15 | 0.05 | n-heptane | " | atmospheric pressure | 34 | 11 | 0.15 |
| Example 22 | B-16 | 0.20 | n-heptane | " | atmospheric pressure | 35 | 12 | 0.2 |
| Example 23 | B-17 | 0.01 | n-heptane | " | atmospheric pressure | 28 | 9 | 0.05 |
| Example 24 | B-18 | 0.45 | n-heptane | " | atmospheric pressure | 32 | 10 | 0.1 |
| Example 25 | B-19 | 0.35 | n-heptane | " | atmospheric pressure | 36 | 12 | 0.2 |
| Example 26 | B-20 | 0.10 | n-heptane | " | atmospheric pressure | 26 | 8 | 0.02 |
| Example 27 | B-21 | 0.33 | n-heptane | " | atmospheric pressure | 31 | 10 | 0.1 |
| Example 28 | B-22 | 0.40 | n-heptane | " | atmospheric pressure | 35 | 11 | 0.2 |
| Example 29 | B-23 | 0.22 | n-heptane | " | atmospheric pressure | 33 | 11 | 0.15 |
| Example 30 | B-24 | 0.30 | n-heptane | " | atmospheric pressure | 34 | 11 | 0.15 |
| Example 31 | B-25 | 0.11 | n-heptane | " | atmospheric pressure | 32 | 10 | 0.1 |
| Example 32 | B-26 | 0.50 | n-heptane | " | atmospheric pressure | 30 | 9 | 0.1 |
| Example 33[1] | B-17 | 0.05 | n-heptane | " | atmospheric pressure | 27 | 8 | 0.05 |
| Example 34 | B-20 | 0.06 | n-pentane | 150 | 20 kg/cm$^2$ | 23 | 7 | 0.001 |

note
[1]A residual oil (the properties thereof being as shown in Table 4) obtained by distillation of Kafji crude oil at atmospheric pressure was used.

As is apparent from the foregoing Examples and Comparative Examples, in a case where asphaltene-containing hydrocarbons are incorporated only with a solvent (Comparative Examples 1 and 5), it is substantially impossible to separate the asphltene from the hydrocarbons only by specific gravity precipitation, and the resulting deasphalted hydrocarbons if any in Comparative Examples 1 and 5 would contain a large amount of metal ingredients as compared with those obtained according to the present invention. Accordingly, it is essential for an existing separation installation to include therein special units such as a counter-current extraction tower and a forced separator in order to effect satisfactory separation of asphltene.

In contrast, the addition of both at least one of the specific solvents and a very small amount of at least one of the specific amorphous silicon dioxides and silicate compounds in accordance with this invention, will result in rapid precipitation of asphaltene from an asphaltene-containing oil. It will therefore be possible to separate asphaltene continuously with satisfactory selectivity by the use of a simplified separation installation without such special units.

On the other hand, it is also apparent from the foregoing that there were exhibited somewhat good results in comparative cases wherein an amorphous silicon dioxide or silicate compound used in a larger amount (Comparative Examples 2–4, 6 and 7) than specified in the present invention, as compared with cases wherein such a silicon compound was not used, and that very excellent results were exhibited in the present cases (Examples 1–34) as compared with said comparative cases.

What is claimed is:

1. A continuous process for solvent deasphalting asphaltene-containing hydrocarbons which comprises (I) mixing (A) 100 parts by weight of asphaltene-containing hydrocarbons with (B) 0.005–0.5 parts by weight of at least one member selected from the group consisting of amorphous silicon dioxides and silicate compounds and (C) 50–2,000 parts by weight of at least one member selected from the group consisting of the following solvents (1)–(4):

(1) aliphatic and alicyclic hydrocarbons having 3–20 carbon atoms, (2) saturated aliphatic and saturated alicyclic monohydric alcohols having 1–10 carbon atoms, (3) liquid hydrogen sulfide and (4) liquid carbon dioxide to form a mixture of the materials (A), (B) and (C) and then (II) making the thus formed mixture stand still to precipitate and separate the asphaltene therefrom thereby obtaining a deasphalted oil.

2. A continuous process according to claim 1, wherein the mixing, precipitation and separation are carried out at a temperature of 0°–300° C. under a pressure of 0.5–150 $Kg/cm^2$ with the proviso that the pressure is so high as to prevent evaporation of the solvent used.

3. A continuous process according to claim 1, wherein the silicate compound is attapulgite, vermiculite, a mica group mineral, pyrophyllite, talc, glauconite, a chlorite group mineral, a septechlorite group mineral, hydralsite, a serpentine group mineral, stilpnomelane, allophane, a kaolin group mineral, a montmorillonite group mineral, a zeolite group mineral, clay, synthetic calcium silicate, synthetic aluminum silicate or synthetic zeolite.

4. A continuous process according to claim 1, wherein the amorphous silicon dioxides are 0.5–1,000 mu in average particle size of primary particles.

5. A continuous process according to claim 1, wherein the silicate compounds have an average particle size of 0.01–1 mm.

6. A continuous process according to claim 3, wherein the silicate compounds have the average particle size of 0.01–1 mm.

7. A continuous process according to claim 1, wherein the solvent other than liquid hydrogen disulfide and liquid carbon dioxide is propane, n-butene, n-pentene, n-hexane, n-heptane, n-propanol, n-isopropanol, n-butanol or a mixed solvent containing (1) a hydrocarbon selected from the group consisting of propane, n-butane and n-pentane and (2) an alcohol selected from the group consisting of n-propanol, isopropanol and n-butanol.

8. A continuous process according to claim 1, wherein the asphaltene-containing hydrocarbons are a residual oil obtained at the time of atmospheric pressure distillation of a crude oil, a residual oil at the time of reduced pressure distillation and a residual oil at the time of cracking each in the step of refining of petroleum.

* * * * *